US005524538A

United States Patent [19]

Voge et al.

[11] Patent Number: 5,524,538

[45] Date of Patent: Jun. 11, 1996

[54] SHEET-FED ROTARY OFFSET PRINTING MACHINE WITH A PLURALITY OF PRINTING UNITS IN SERIES CONFIGURATION

[75] Inventors: Michael Voge, Malsch; Oliver Koch, Heidelberg, both of Germany

[73] Assignee: Heidelberger Druckmaschinen AG, Heidelberg, Germany

[21] Appl. No.: 440,718

[22] Filed: May 15, 1995

[30] Foreign Application Priority Data

May 13, 1994 [DE] Germany ..... 44 16 974.4

[51] Int. Cl.[6] ..... B41F 9/00

[52] U.S. Cl. ..... 101/142; 101/177; 101/183

[58] Field of Search ..... 101/142, 177, 101/181, 183, 211, 232, 234, 247, 248, 216, 219

[56] References Cited

U.S. PATENT DOCUMENTS

| | | | |
|---|---|---|---|
| 2,554,904 | 5/1951 | Harrold | 101/183 |
| 3,557,692 | 1/1971 | Lee | 101/183 |
| 3,946,669 | 3/1976 | Johne et al. | 101/183 |
| 4,450,766 | 5/1984 | Inomata et al. | 101/211 |
| 4,493,255 | 1/1985 | Fischer | 101/183 |
| 4,854,231 | 8/1989 | Jahn | 101/177 |
| 5,036,764 | 8/1991 | Rodi | 101/181 |
| 5,136,943 | 8/1992 | Fischer et al. | 101/183 |
| 5,156,638 | 10/1992 | Wirz | 101/142 |
| 5,377,589 | 1/1995 | Krüger et al. | 101/248 |
| 5,421,257 | 6/1995 | Okuda | 101/232 |

FOREIGN PATENT DOCUMENTS

| | | |
|---|---|---|
| 39843 | 6/1965 | Germany . |
| 4032442 | 4/1992 | Germany . |

*Primary Examiner*—Eugene H. Eickholt

*Attorney, Agent, or Firm*—Herbert L. Lerner; Laurence A. Greenberg

[57] ABSTRACT

Oscillations caused by machine dynamics in a sheet-fed rotary offset printing machine affect the print quality. The disturbing oscillations are reduced in that printing units of the printing machine are offset relative to one another at a phase angle at which identical print events in at least two printing units occur simultaneously.

4 Claims, 3 Drawing Sheets

SHEET-FED ROTARY OFFSET PRINTING MACHINE WITH A PLURALITY OF PRINTING UNITS IN SERIES CONFIGURATION

BACKGROUND OF THE INVENTION

1. Field of the Invention

The invention relates to an sheet-fed offset rotary printing machine with a plurality of print units in series configuration for multi-color printing, in which the printing units which are mutually disposed in series are offset relative to one another by a phase angle and at least one deflecting roller is respectively disposed between the printing units.

The phase angle is thereby defined as that angle between the printing units by which the identical print events are initiated mutually offset as compared to the neighboring print units; such print events are, for instance, beginning of print (position of leading edge of the plate), end of print (position of trailing edge of the plate), channel rollover or groove runby, beginning of ductor roller, transfer roller, ink feed roller, or vibrator, and caming torques, relative to the cylinder rotating at unit base speed. These and other parameters initiate oscillations in a broad spectrum in the print units and they cause undesirable oscillatory frequences of the printing machine with disadvantageous influence on the print quality. Particularly strong initiation of the machine-harmonic frequencies originate from the caming torques necessary in the paper-guiding cylinders. These oscillations lead to print errors, such as mackle and register errors in the sheet transfer.

2. Description of the Related Art

Phase angle relationships between printing units of a printing machine have been heretofore dealt with in German published, non-prosecuted application DE-OS 40 32 442. The angle in question of that publication is the defined angle between the unit-sized plate or rubber blanket cylinder and the triple-sized transfer cylinder. The proposed angle offset is 18° or 54°, so as to enable perfector printing with a printing machine in a structurally simple manner.

From German published, non-prosecuted application DE-OS 32 03 879 there has become known a sheet-fed rotary offset printing machine of a special construction with printing units disposed in series, but without deflecting cylinders between the printing units. In that configuration the impression cylinder of the printing unit presses against the rubber blanket cylinder of the adjacent printing unit. There is provided between the connecting lines of the axes of the rubber blanket cylinder and the impression cylinder of respectively adjacent printing units an angle of between 70° and 175°. That angle results from a reduction in the number of components necessary for sheet transport.

SUMMARY OF THE INVENTION

It is accordingly an object of the invention to provide a sheet-fed rotary offset printing machine with a plurality of printing units in series configuration, which overcomes the above-mentioned disadvantages of the heretofore-known devices and methods of this general type; the primary object is to attain a reduction of the machine vibrations for decreasing the printing errors caused thereby by means of a phase angle distribution, and as much as possible without structural component changes.

With the foregoing and other objects in view there is provided, in accordance with the invention, a sheet-fed rotary offset printing machine, comprising:

a plurality of printing units mutually disposed in series and processing various print events, each of the printing units operating at a respective phase angle;

at least one deflecting roller disposed between each pair of adjacent printing units;

the phase angles of respective ones of the printing units being offset relative to one another such that identical print events occur simultaneously or synchronously in at least two of the printing units.

In accordance with an added feature of the invention, the printing machine is a half-speed printing machine and each of the printing units includes an impression cylinder having an axis and a deflecting roller having an axis, wherein a straight line connecting the axes of the impression cylinder and a following deflecting roller together with a horizontal line enclose an angle $\alpha$, and wherein the angle $\alpha$ corresponds to one eighth of the given phase angle.

In accordance with a concomitant feature of the invention, the printing units operate at a given unit speed, and each of the printing units include a half-speed impression cylinder and a third-speed deflecting roller following the impression cylinder as seen in a paper product travel direction, wherein a straight line connecting the axes of the impression cylinder and the following deflecting roller together with a horizontal line enclose an angle $\alpha$, and the angle $\alpha$ is defined by a relationship $$\text{angle } \alpha = (\text{phase angle } +180°): 10.$$

In other words, the solution as proposed herein lies in that in multi-color printing machines with several printing units in series configuration and with deflecting rollers disposed between the printing units, the printing units are mutually offset by a phase angle which results in at least two of the printing units to operate synchronously.

Exact synchronization is difficult to attain because of tolerances. However, a range of plus or minus two degrees of respective phase angle deviations may be tolerated, as compared to the setpoint phase angles of 90°, 120°, 180°. Relative to the exact angles—the setpoint phase angles—phase angles outside of that range exhibit worse behavior with regard to machine dynamics. These angles, nevertheless, show a substantially more advantageous behavior as compared to arbitrarily selected phase angles.

This provision leads to the result that error sources, as for instance camming events for the gripper control of a paper guiding cylinder, are initiated simultaneously and run in synchronicity in at least two printing units. On average, therefore, the basic machine vibration which is detrimental to print quality (i.e. the first harmonic of the rotary oscillation) as well as higher harmonics are least initiated through a large range of printing speeds. Printing errors can thereby be avoided, the origin of which would lie in the machine dynamics.

What is further achieved, however, is also a shortening of the assembly times of the machine setting, because at least two, or possibly even more printing units (e.g. every other printing unit of a half-speed printing machine) stand in the same position. If, for example, the print event starts at a phase angle of 90° in the n-th printing unit, the same print events are initiated simultaneously in the printing unit n+4 and they run synchronously. A phase angle of 120° accordingly synchronizes the occurrence of identical print events in the n-th printing unit with those in the printing unit n+3; a phase angle of 180° synchronizes the occurrence of events in the n-th printing unit with those in the printing units n+2, n+4, n+6, etc. In the latter case, the grooves of the plate and the rubber blanket cylinder of the one printing unit lie on one another, while in the adjacent printing unit it is the grooves of the plate cylinder and the rubber blanket cylinder which face each other.

In a half-speed printing machine, in which the impression cylinder and the guide cylinders rotate at half speed relative to the plate cylinder, it is possible to establish a relationship between the phase angle and an angle alpha ($\alpha$). The angle $\alpha$ is enclosed by a connecting line between the axis of the impression cylinder and the axis of the guide cylinder and the horizontal. The resulting relationship is that the phase angle is eight times greater than the angle $\alpha$.

A further relationship results in printing machines with a half-speed impression cylinder and a third-speed guide cylinder in that the phase angle is ten times greater than the angle between the connecting line of the impression cylinder axis—deflecting cylinder axis and the horizontal and completed by the quotient 1 through 180°.

Other features which are considered as characteristic for the invention are set forth in the appended claims.

Although the invention is illustrated and described herein as embodied in a sheet-fed rotary offset printing machine with a plurality of printing units in series configuration, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DESCRIPTION OF THE PREFERRED EMBODIMENTS

Figure 1:
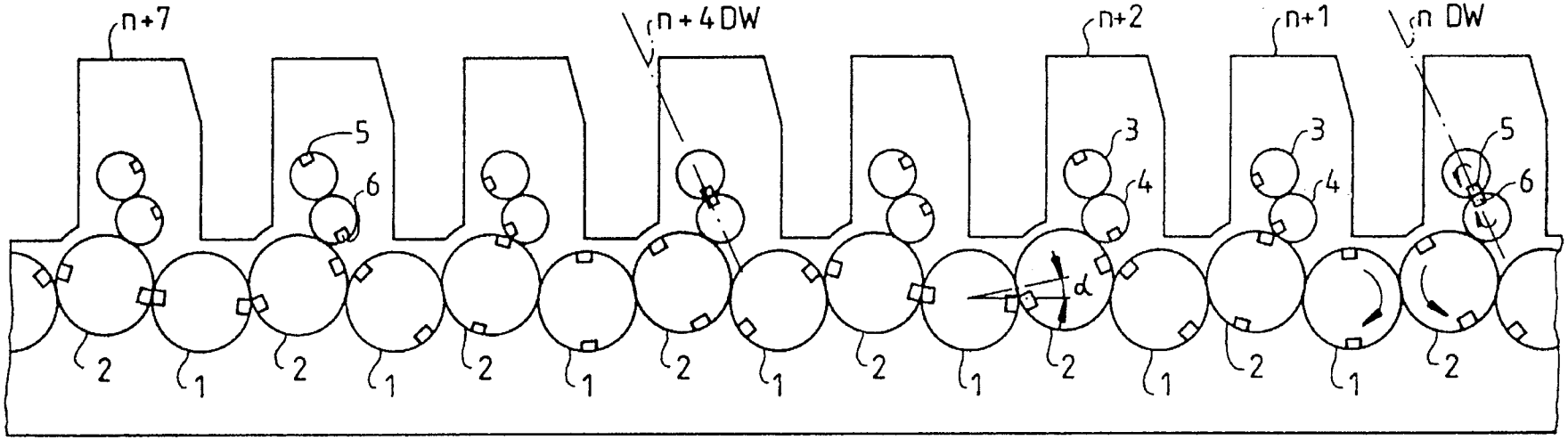
FIG. 1 is a schematic side-elevational view of a multi-color offset printing machine.

Referring now to the figures of the drawing in detail and first, particularly, to FIG. 1 thereof, there is seen a schematic of an sheet-fed rotary offset printing machine for multi-color printing with eight printing units n, n+1, n+2, to n+7. Between the printing units there are disposed respective deflecting cylinders or deflecting rollers 1 between the impression cylinders 2 of the printing units. Between the plate cylinder (rotating at unit speed) and the rubber blanket cylinder 4 (also rotating at unit speed), there is provided the impression cylinder 2 of each printing unit and the deflecting rollers 1. The impression cylinder 2 and the deflecting roller 1 each has twice the diameter of the plate and rubber blanket cylinders, so that they rotate at half speed.

The phase angles between the individual printing units according to the example in FIG. 1 is 90°, so that the print events in the first printing unit n and in the fifth printing unit n+4 are triggered simultaneously and they run at mutual synchronicity. Accordingly, the print events in the second printing unit n+1 and the sixth printing unit n+5, in the third printing unit n+2 and the seventh printing unit n+6, as well as in the fourth printing unit n+3 and the eighth printing unit n+7 are triggered simultaneously. In FIG. 1 there is shown a machine position in which the groove 5 of the plate cylinder 3 and the groove 6 of the rubber blanket cylinder 4 lie on one another in the printing units n and n+4, and they are located in a mutually opposite location in the printing units n+2 and n+6.

The angle $\alpha$ is enclosed by a straight connecting line from the axis of the deflecting roller 1 to the axis of the impression cylinder 2 of the preceding printing unit and the horizontal. The definition of the angle $\alpha$ is in a side-elevational view, i.e. axially into the various cylinders.

Figure 2:
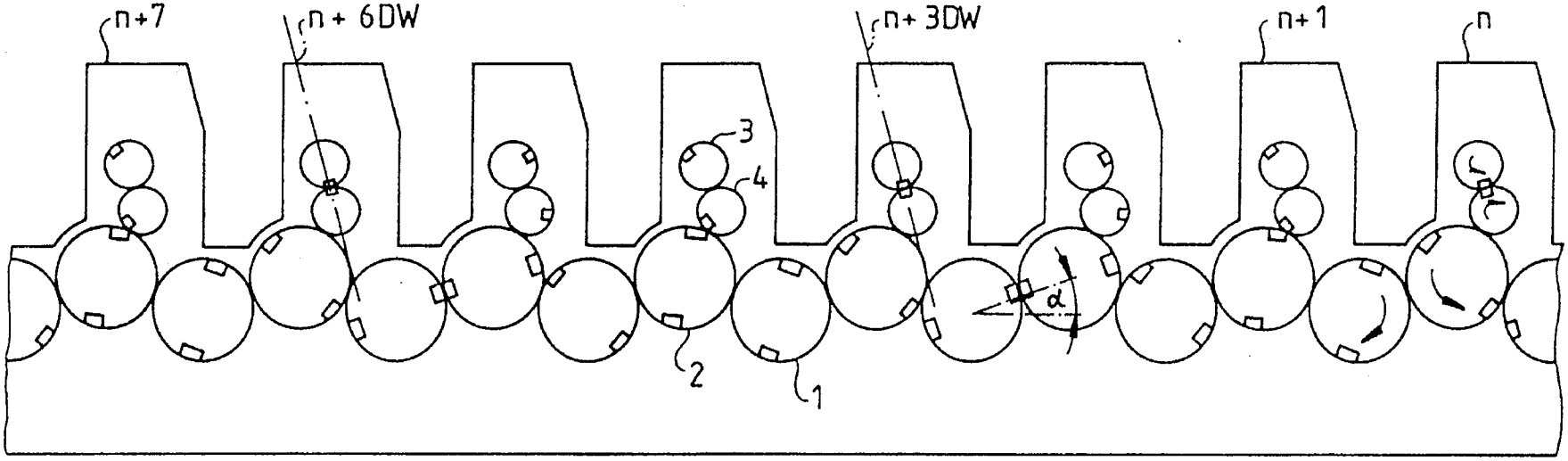
FIG. 2 is a similar view of an alternative embodiment of the invention.

FIG. 2 illustrates a schematic of a multi-color printing machine according to FIG. 1 with a phase angle of 120°. In this phase angle the print events in the first printing unit n, the fourth printing unit n+3, and the seventh printing unit n+6 run simultaneously. Similarly, the chronology of the print events in the second printing unit n+l, in the fifth printing unit n+4, and in the eighth printing unit n+7 are synchronized.

The schematic of FIG. 2 also shows printing units with plate cylinders 3 running at unit-speed and rubber blankets running at unit-speed, as well as double-sized deflecting rollers 1 between equally double-sized impression cylinders 2. The angle $\alpha$ is also enclosed by the horizontal and the straight connecting line between the axes of the deflecting cylinder 1 and the impression cylinder 2, and it is defined as above.

Figure 3:
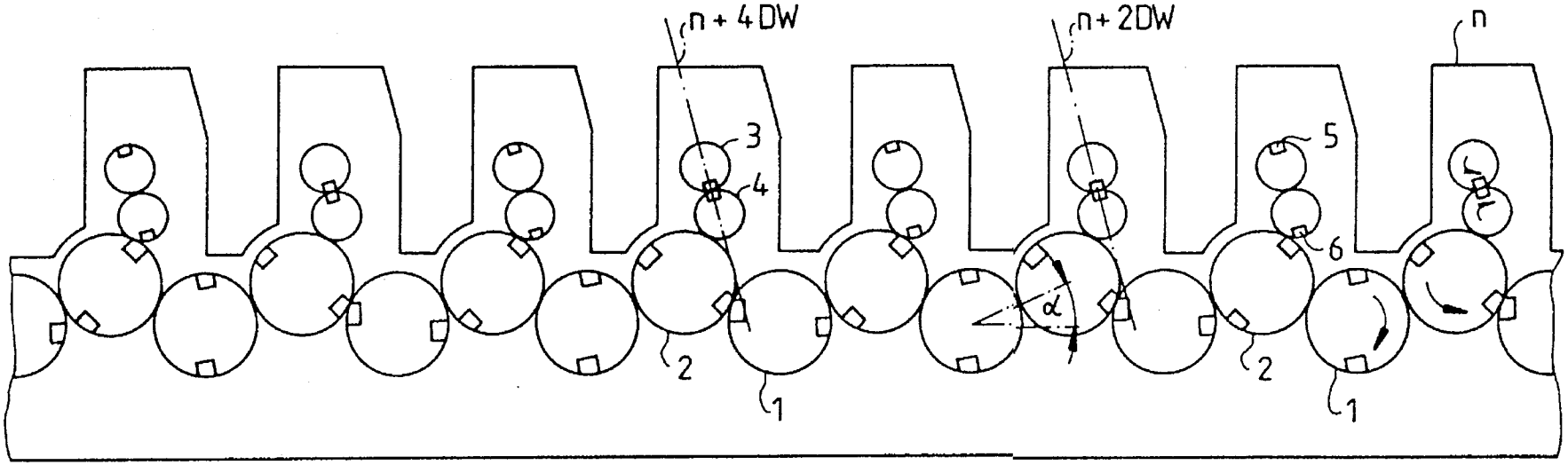
FIG. 3 is a similar view of a further alternative embodiment thereof.

FIG. 3 illustrates an embodiment of a multi-color printing machine with eight printing units n, n+1 to n+7, but with a phase angle of 180°. With such a phase angle, print events occur simultaneously in every other printing unit.

We claim:

1. A sheet-fed rotary offset printing machine, comprising:

a plurality of printing units mutually disposed in series and processing various print events, each of said printing units operating at a respective phase angle;

at least one deflecting roller disposed between each pair of adjacent printing units;

the phase angles of respective ones of said printing units being offset relative to one another such that identical print events occur simultaneously in at least two of said printing units.

2. The sheet-fed rotary offset printing machine according to claim 1, wherein said phase angles are offset relative to one another such that identical print events are processed synchronously in said at least two of said printing units.

3. The sheet-fed rotary offset printing machine according to claim 1, wherein the printing machine is a half-speed printing machine and each printing units includes an impression cylinder having an axis and a deflecting roller having an axis, wherein a straight line connecting the axes of said impression cylinder and a following deflecting roller together with a horizontal line enclose an angle $\alpha$, and wherein the angle $\alpha$ substantially corresponds to one eighth of the given phase angle.

4. The sheet-fed rotary offset printing machine according to claim 1, wherein said printing units operate at a given unit speed, and each of said printing units include a half-speed impression cylinder with an axis and a third-speed deflecting roller with an axis following said impression cylinder as seen in a paper product travel direction, wherein a straight line connecting the axes of said impression cylinder and said following deflecting roller together with a horizontal line enclose an angle $\alpha$, and the angle $\alpha$ is defined by a relationship $$\text{angle } \alpha = (\text{phase angle} + 180°) : 10.$$

* * * * *